United States Patent [19]

Williams et al.

[11] Patent Number: 4,704,756

[45] Date of Patent: Nov. 10, 1987

[54] WATER-POWERED BACK SCRUBBER

[75] Inventors: Clarence O. Williams, Rocky Mount; David C. Lanier, Holly Ridge, both of N.C.

[73] Assignee: David C. Lanier, Holly Ridge, N.C.

[21] Appl. No.: 943,210

[22] Filed: Dec. 18, 1986

[51] Int. Cl.[4] ..... A46B 13/06

[52] U.S. Cl. ..... 15/21 R; 15/21 B; 15/22 R; 128/53

[58] Field of Search ..... 15/21 R, 21 B, 21 C, 15/21 D, 97 R, 22 R; 128/47, 50, 53

[56] References Cited

U.S. PATENT DOCUMENTS 3,768,462 10/1973 Boulard ..... 128/53

3,875,604 4/1975 Wurn ..... 15/21 R

*Primary Examiner*—Edward L. Roberts

*Attorney, Agent, or Firm*—B. B. Olive

[57] ABSTRACT

A shower brush apparatus incorporates a reciprocating brush operated by a water pump operated by water diverted from the shower head supply.

5 Claims, 6 Drawing Figures

WATER-POWERED BACK SCRUBBER

TECHNICAL FIELD

The invention relates broadly to water-powered brushes and more specifically to a shower accessory providing a shower water powered brush.

BACKGROUND ART

It has been known to divert water in a shower stall and use the water to operate a back scrubbing brush. In some instances, the water power has been used to reciprocate a back brush and in other cases has been used to rotate a brush. Representative and useful background prior art may be found in U.S. Pat. Nos. 1,192,314, 2,068,757, 3,042,949, 3,085,169, 4,151,623, and 4,155,137. While the prior art has recognized the practical advantage of using the shower water to operate a back-scrubbing brush, the concept as such has never been commercialized presumably because of a lack of a simple, easily manufactured assembly which the present invention seeks to obtain. While not related to a shower brush, U.S. Pat. No. 4,557,003 teaches diverting shower water to a shower mirror.

DISCLOSURE OF INVENTION

According to the invention a manually operable T-valve is mounted between the shower head and the water inlet. When the T-valve is opened, water is diverted to a reciprocating piston arrangement which uses the water power to drive a vertically reciprocating brush between a pair of laterally spaced, relatively fixed but removable brushes which provide the desired brushing effect. The brush assembly of the invention can either be mounted in a supporting bracket or removed and used as a hand-held, water-powered brush. The supporting bracket is also adapted to receive a non-powered brush when desired.

BEST MODE FOR CARRYING OUT THE INVENTION

Figure 1:
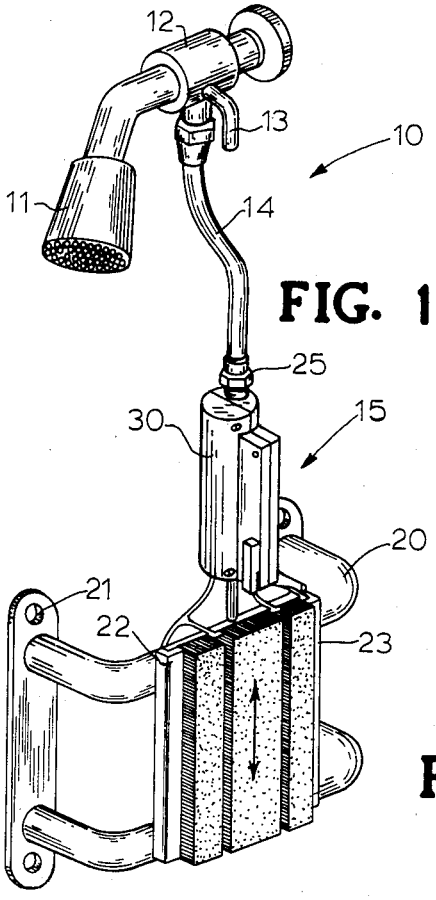
FIG. 1 is a perspective view of a water-powered back scrubber according to the invention illustrating the invention scrubber connected to a shower head and with the scrubber positioned in a wall-mounted bracket.

The water-powered back scrubber apparatus 10 of the invention comprises a conventional shower head 11 equipped with a T-valve 12 and valve actuator 13. A connecting flexible pipe 14 connects valve 12 and back scrubber assembly 15 for conveying water to be used for showering to back scrubber assembly 15. Pipe 14 is preferably of sufficient length to allow scrubber 15 to reach all parts of the body desired to be scrubbed when the scrubber assembly 15 as seen in FIG. 3 is held in the hand as later described.

A wall mount bracket 20 is designed to receive back scrubber assembly 15 as illustrated in FIG. 1. Bracket 20 is mounted on the shower wall in any desired location by screws (not shown) passing through holes 21 of bracket 20. Vertical guides 22, 23 are adapted to slidably receive mating guides 41, 44 of scrubber assembly 15 and thereby support the scrubber assembly 15 assembly between guides 22, 23 during use. The entire back scrubber assembly 15 is designed such that it may also be held in the hand of the user simply by removing the scrubber assembly 15 from the bracket 20 as in FIG. 3.

Figure 5:
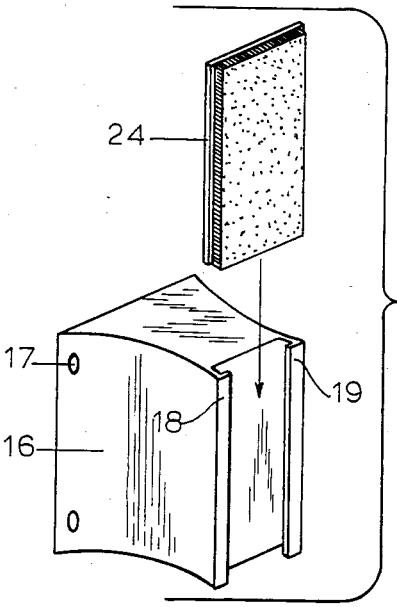
FIG. 5 is a perspective view of an alternative type bracket adapted to receive a non-powered brush in an alternative brushing arrangement.

In an alternative arrangement, a different style of bracket 16 (FIG. 5) is secured to the shower wall by screws, not shown, passing through holes 17. The alternative bracket 16 as does bracket 20 receives either the scrubber assembly 15 of FIG. 3 in guides 18, 19 or when desired a fixed scrubbing brush 24.

Figure 2:
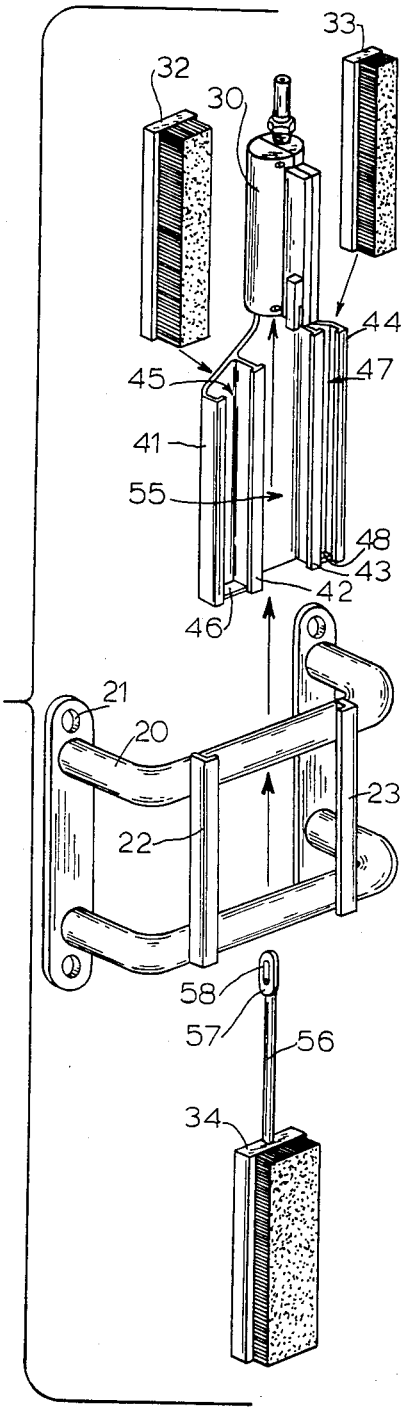
FIG. 2 is an exploded perspective view of the water-powered back scrubber of FIG. 1 and the supporting bracket with the shower head and water connection being eliminated for simplification of the drawing.
Figures 3, 4, 6:
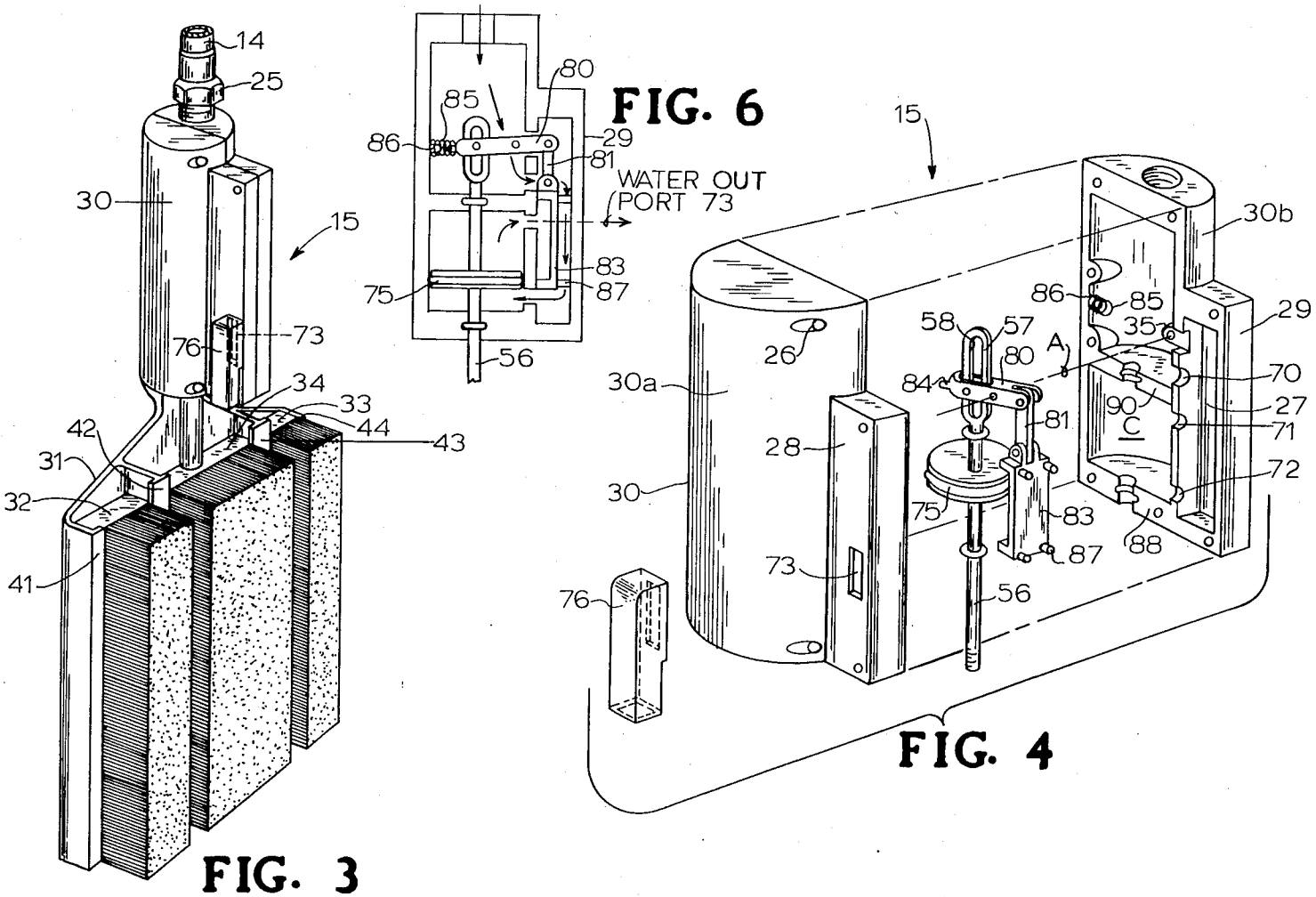
FIG. 3 is an enlarged perspective view of the water-powered back scrubber of the invention removed from the bracket suited to being held in the hand.
FIG. 4 is an exploded perspective view of the water-powered brush drive mechanism of the invention.
FIG. 6 schematically illustrates water flow to and from the scrubber.

Referring primarily to FIGS. 3 and 4, scrubber assembly 15 is illustrated as comprising a valve chamber 30 externally shaped for being held in the hand, an intregal brush holder 31, stationary but removable vertical side brushes 32, 33 and vertically movable scrubbing brush 34. Valve chamber 30 is suitably secured to brush holder 31 which is provided with opposed vertical brush guide rails 41, 42 on the left hand side and with vertical opposed brush guide rails 43, 44 on the right hand side as viewed in FIG. 2. Side brush 32 is slid into a first channel 45 formed between guide rails 41 and 42. Brush 32 rests on its lower end against bottom stop member 46. Side brush 33 is slid into a second channel 47 formed between guide rails 43 and 44. Brush 33 rests on its lower end against bottom stop 48.

A third channel 55 slidably receives brush 34 between guide rails 42 and 43. Brush 34 is driven by means of an elongated rod 56 which extends vertically from the top of brush 34 to which it is threadably secured. The upper end of rod 56 has a flattened-out portion 57 formed with a slot 58.

As previously mentioned, scrubber assembly 15 has a valve chamber 30 mounted above and secured to brush holder 31. Components associated with chamber 30 include ports 70, 71, 72, and 73, piston 75, linkages 80, 81, valve 83 and compression spring 85 mounted between pin 84 on linkage 80 and pin 86 within chamber 30. Cover 76 covers port 73. Valve 83 slides on spacer pins 87. Water enters valve chamber 30 from connecting pipe 14 through connection 25. It will be understood that when the two molded halves **30*a* and 30*b* of valve chamber 30 are secured together by screws, not shown, passing through screw holes 26, piston 75 will reside in the piston chamber C defined by walls 88, 90, one half of which is seen in FIG. 4, valve 83 will be slidably retained within the channels 27 in valve housings 28, 29 and a pivot pin, not shown, will pivotally support linkage 80 on axis A and will be mounted in pin supports 35, one of which is seen in FIG. 4**.

In operation, a constant stream of incoming pressurized water enters valve chamber 30 through connection pipe 14 at the top and flows into the top of chamber 30 above piston chamber C. When valve 83 is up, the water flows into and between valve housings 28,, 29 and then flows on the back surface of valve 83 between spacer pins 87 and enters cylinder C through lower port 72. This raises piston 75. Water on the top side of piston 75 from the previous stroke is exhausted out port 71, in front of valve 83, and then to port 73 to run down through cover 76 on brush 34 and the person's back being scrubbed.

As piston 75 travels through approximately one half of its stroke, rod 56 engages linkage 80. As it continues to move linkage 80 to a point slightly beyond its horizontal position, compression spring 85 flips linkage arm 80, moves valve 83 down and upper port 71 begins to fill from chamber 30 and port 72 begins to exhaust through port 73. Thus, a continuous reciprocating motion of brush 34 is achieved and a "dead" or "non-motion" position is prevented by the intermittent action of spring 85.

What is claimed is:

1. In a shower apparatus having a water supply for dispensing shower water through a shower head, a shower brush assembly, comprising:

(a) a valve connected between a shower water supply and a shower head and being positionable to divert water from said shower water supply to a valve outlet;

(b) a support structure adapted to be mounted on a vertical wall of a shower stall or the like;

(c) a unitary shower brush assembly comprising:

(i) a base structure adapted to be loosely received and fixedly supported by said support structure;

(ii) first and second laterally-spaced vertical brushes loosely supported by said base structure in fixed positions thereon;

(iii) a third vertical brush mounted for reciprocation on said base structure between said first and second brushes; and (iv) water-operated reciprocating pump means mounted on said base structure and operatively connected to reciprocate said third vertical brush and discharge water thereon; and (d) a tubular connector connecting said valve outlet to said pump means whereby when said valve is positioned to divert water to said valve outlet said pump means reciprocates said third brush and discharges water thereon.

2. In a shower apparatus as claimed in claim 1 wherein:

(a) said support structure includes a first pair of laterally-spaced vertical guides;

(b) said base structure is adapted to be loosely received and fixedly positioned by said first pair of guides; and (c) said base structure includes third and fourth pairs of laterally spaced apart vertical guides for loosely receiving and fixedly positioning said first and second vertical brushes and for slidably receiving said third vertical brush therebetween.

3. In a shower apparatus as claimed in claim 1 including a fourth brush adapted to be interchangeably supported in said support structure with said shower brush assembly.

4. In a shower brush apparatus as claimed in claim 1 wherein said tubular connecting means is flexible and said pump means is shaped to be hand held enabling the entire said shower brush assembly to be removed from said support structure and operated in a hand-held position.

5. In a shower apparatus having a water supply for dispensing shower water through a shower head, a shower brush assembly, comprising:

(a) a valve connected between a shower water supply and a shower head and being positionable to divert water from said shower water supply to a valve outlet;

(b) a support structure adapted to be mounted on a vertical wall of a shower stall or the like;

(c) a unitary shower brush assembly comprising:

(i) a base structure adapted to be loosely received and fixedly supported by said support structure.

(ii) a vertical brush mounted for reciprocation on said base structure;

(iii) water-operated reciprocating pump means mounted on said base structure and operatively connected to reciprocate said vertical brush and discharge water thereon; and (d) a tubular connector connecting said valve outlet to said pump means whereby when said valve is positioned to divert water to said valve outlet said pump means reciprocates said brush and discharges water thereon.

* * * * *